United States Patent [19]

Liu

[11] Patent Number: 4,658,666

[45] Date of Patent: Apr. 21, 1987

[54] STRUCTURE OF ROCKING ROD FOR NEW TYPE HORIZONTAL CONTACT VIDEO GAME

[76] Inventor: Lai-Jin Liu, 2F. #328 Mu Cha Rd. Sec. 1, Mu Cha Ward, Taipei, Taiwan

[21] Appl. No.: 556,697

[22] Filed: Nov. 30, 1983

[51] Int. Cl.[4] ..... G05G 1/00

[52] U.S. Cl. ..... 74/471 XY; 74/523; 74/473 R; 74/559; 74/565; 200/DIG. 23; 273/148 B

[58] Field of Search ..... 74/471 XY, 473 R, 559, 74/565, 523; 200/6 A, 6 R, DIG. 2, DIG. 23; 273/DIG. 28, 85 G, 310, 312, 148 B

[56] References Cited

U.S. PATENT DOCUMENTS

| | | | |
|---|---|---|---|
| 3,360,620 | 12/1967 | Ward | 74/471 X |
| 3,832,895 | 9/1974 | Strandh | 74/471 XY X |
| 4,459,578 | 7/1984 | Sana et al. | 74/471 XY X |
| 4,470,320 | 9/1984 | Kim | 74/741 XY |
| 4,489,303 | 12/1984 | Martin | 74/471 XY |
| 4,489,304 | 12/1984 | Hayes | 74/471 XY |
| 4,491,325 | 1/1985 | Bersheim | 74/471 XY X |

*Primary Examiner*—Larry Jones

[57] ABSTRACT

An improved rocking rod assembly for a new type of horizontal contact video game including a horizontal contact type circuit element, a rocking rod having a base end thereof provided with guide rails, a fixed ring having a central hole, guide grooves in the central configured to match the guide rail, and a resilient elastic mid-ring. In another embodiment, the present rocking rod assembly includes a double key.

2 Claims, 4 Drawing Figures

STRUCTURE OF ROCKING ROD FOR NEW TYPE HORIZONTAL CONTACT VIDEO GAME

FIELD OF USE

The present invention relates to an improved rocking rod assembly suitable for new types of horizontal contact video games.

BACKGROUND OF THE INVENTION

The conventional rocking rod suffers form the following defects:

(1) The circuit system for controlling the direction of the rocking rod always uses imported electronic parts and the manufacturing procedure is more complicated; therefore, the manufacturing costs are increased.

(2) In the conventional structure, only a combination of the rocking rod and fixed rin 2 is present; there is no setting ring. That will not permit prolonged useful operation. Therefore, after long periods of use a gap will develop between the rod and the central hole of the final ring. Accordingly, the structural relationship and fit between components becomes non-conforming due to the friction of automatic rotation, and thus user can no longer enjoy the use of an accurate control effect.

(3) In the conventional device, the fixed ring of the rocking rod is made of hard material and does not possess elasticity. After the force applied to the handle is stopped, the device (rod) does not automatically return to the original place. The operator feels the control is stiff during use.

(4) The control key associated with the conventional rocking rod is always a single key; this makes both a left-handed or right-handed operator feel uncomfortable during operation. If the force applied to the key is over-loaded, damage will result to the key.

(5) The rocking rod is direct contact type, therefore, it is easy to wear down and lacks precision.

SUMMARY OF THE INVENTION

In contrast to the above-disadvantages and defects associated with the remote controller, the present invention provides a novel rocking rod apparatus assembly which is durable, simple to manufacture, inexpensive to make, and convenient to operate. Its characteristic is that rocking rod can control direction by indirect contact and possess a double-key operation.

The rocking rod of the present invention if for horizontal type contact video games. In the present invention provides an improved circuit element, this element is a horizontal type circuit element. At the base end of the shaft of the rocking rod are guide rails. The guide rails match a respective guide groove. The guide grooves are provided in the central passageway. The central passageway is part of a fixed ring, preferably including an elastic mid-ring. When the force applied to the rocking rod is stopped, the rocking rod can automatically return to the original rest position. This prevents the phenomenon of automatic rotation because the mid-ring rubber ring is elastic and always urges the rocking rod back towards its original rest position and the guide rail and guide group system prevents the rocking rod from rotating with respect to the fixed ring. Therefore, the matching guide rails and groove arrangement can ensure the critical and precise positioning of the rocking rod. A setting ring is placed around the portion of the base shaft section of the rocking rod protruding past the fixed ring in order to prevent the rocking rod from separating from the fixed ring. Another embodiment provides a rocking rod controller assembly having a double-key operation. The latter embodiment is suitable for either left-handed or the right-handed people. The multi-functional operation and popular design are facets of the improvement over the conventional single key structure.

DESCRIPTION OF THE PREFERRED EMBODIMENT

Figure 1:
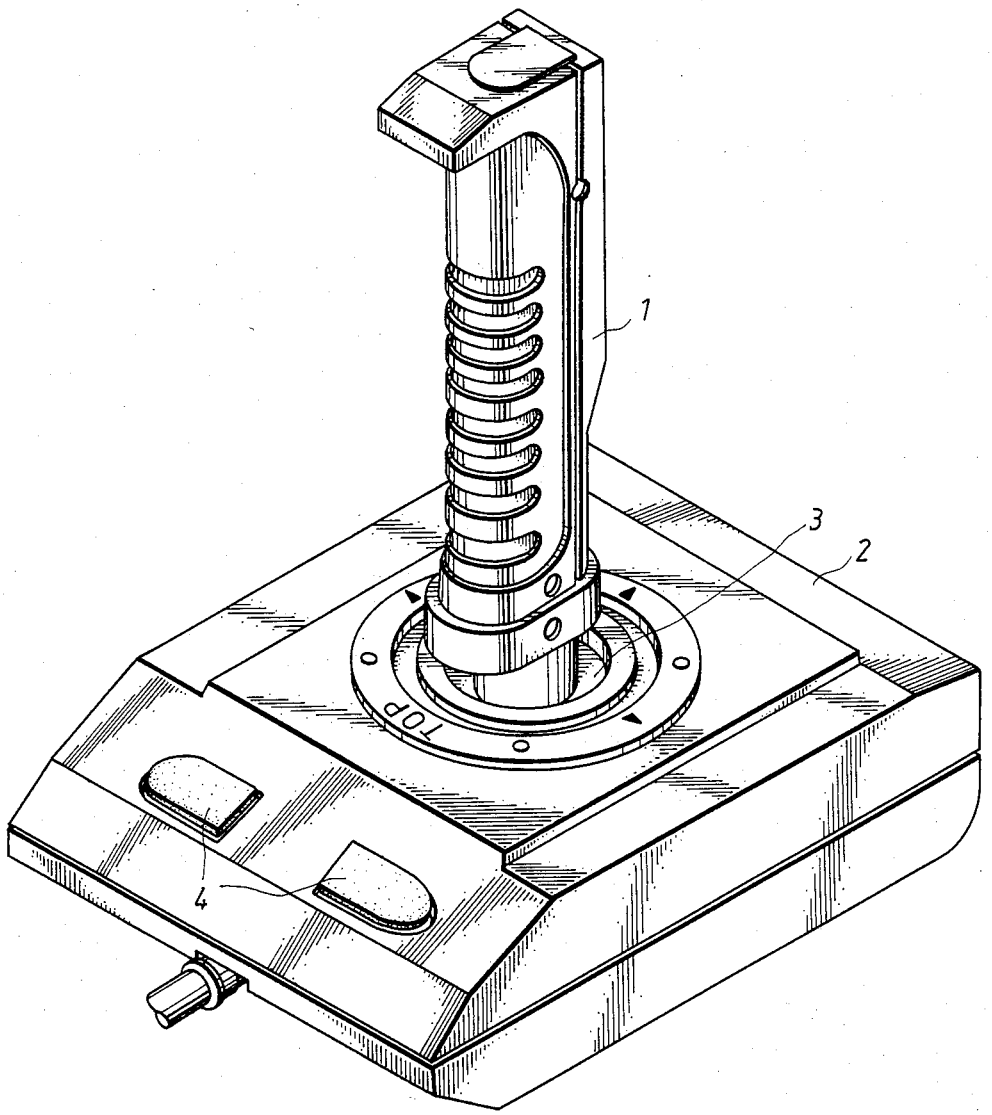
FIG. 1 is a perspective view of an embodiment of the present invention.

As shown in FIG. 1, the present invention comprises a rocking rod (1), a cover (2), a fixed ring (3), circuit elements (6) and an operation key (4).

Figure 3:
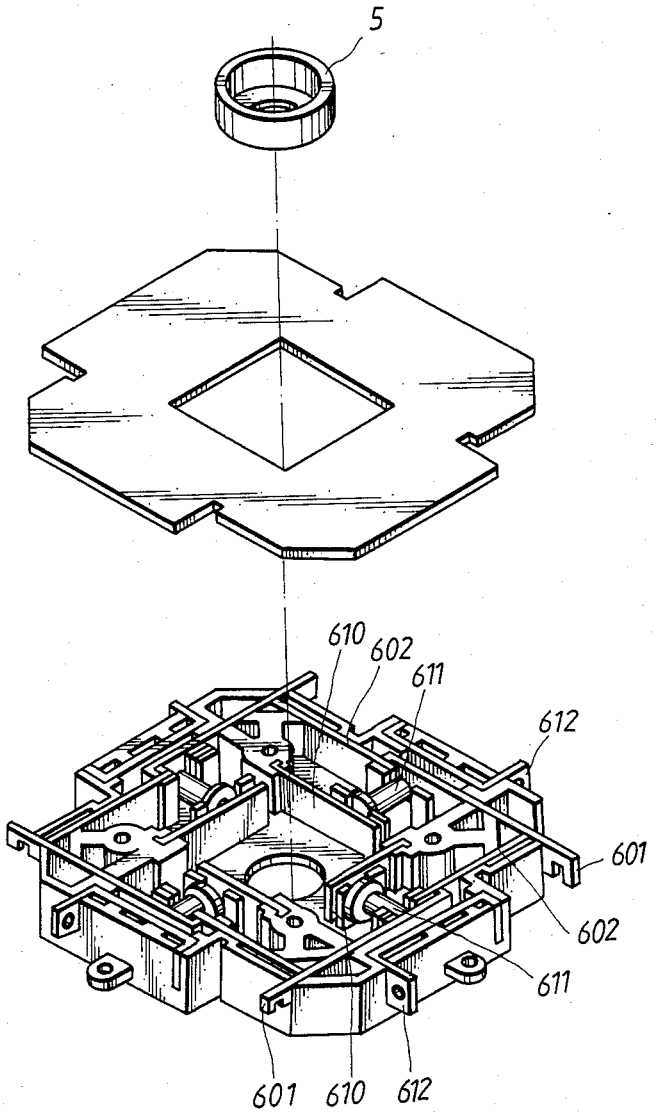
FIG. 3 is a perspective segmented view of an embodiment of the circuit elements of the present invention.

The net control function of the out-put from circuit elements (6) of the present invention is as same as in the conventional circuit board. However, the manufacturing procedure of the present invention is simpler than the conventional circuit board and its manufacturing cost is low. The method of control direction of circuit elements (6) is that operator applies a force on rocking rod (1) which in turn is transmitted to the base end ring (4) at the lower end of the rocking rod. Base end ring (4) is connected to a shaft stopping ring (5). Stopping ring (5) is positioned in a central square-shaped section in the circle elements (6). The square shaped section is bounded by four spring sheets (610). As a result of the force applied through base end ring (11), the shaft-stopping ring (5) will be urged or rammed against at least one spring sheet (610). Spring sheet (610) will then in turn transmit that pushing force to the push shaft (611). Next, the push shaft (611) will then in turn push against guide sheet (602) and outward guide sheet (601). Outward guide sheet (601) will in turn contact output guide sheet (612). The transmission of force will control one direction, such as east, west, south or north. As shown in FIG. 3, if the operator wants to control a northeast direction, he only needs to apply a force towards a northeastern direction. The base end ring (11) of rocking rod (1) will push shaft-stopping ring (5) such that the external arc of the rocking rod will contact the neighboring east spring sheet (610) and north spring sheet (610). Inward guide sheet (602), outward guide sheet (601), east output guide sheet (612), and north output guide sheet (612) will close respective circuits (not shown) to respectively permit an eastern direction signal and northern direction signal generated by the video game to be transmitted to the video control circuits (not shown) so that the user can thus control, i.e., generate, a northeast direction signal. The user can obtain control over a northeast direction, the southeast, northwest, or a southeast direction by a like-method.

When the applied force is stopped, rocking rod (1) will return and be re-set by the elasticity of fixed ring (3). At that time, shaft-stopping ring (5) also returns to the central position. Each spring sheet (610) is elastic and each will return to its respective original position when no push force is produced. Outward guide sheet (610) separates from output guide sheet (612) and will not continuously produce a direction signal at push shaft (611). In addition, a spring coil is placed there in order to increase the return speed of outward guide sheet (601).

Figure 2:
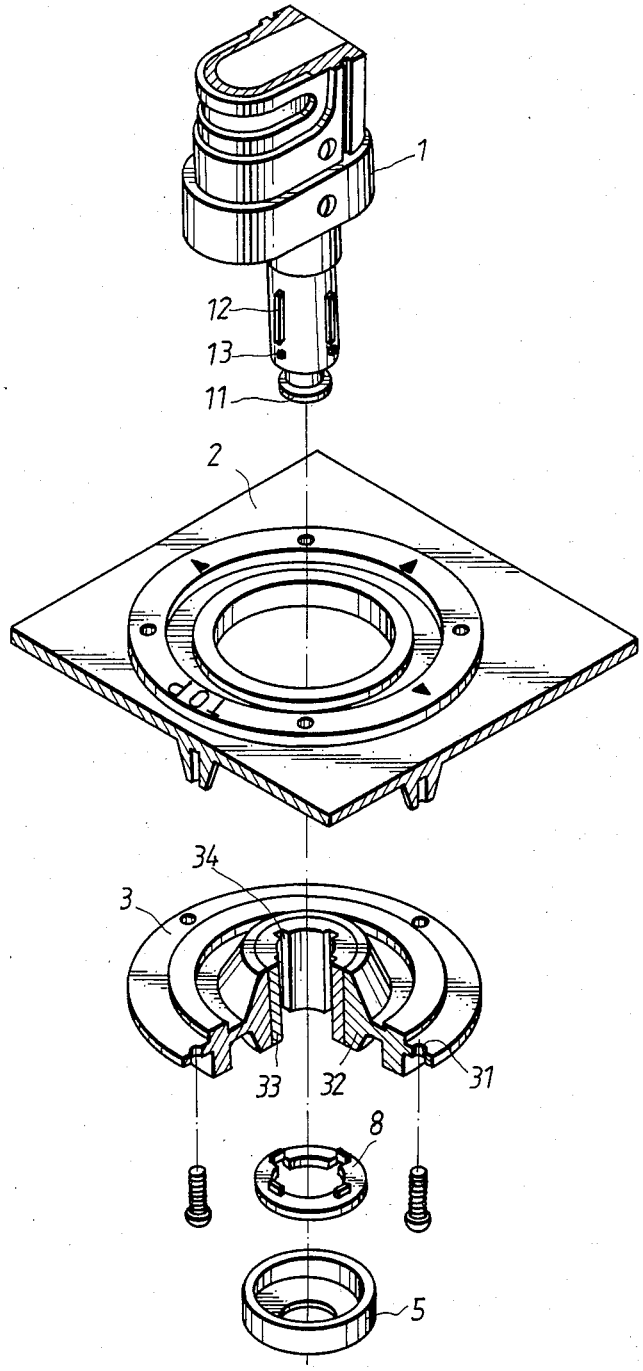
FIG. 2 is a perspective view of an embodiment of rocking rod and fixed ring of the present invention.

As shown in FIG. 2, fixed ring (3) of the present invention is composed of an outer-ring plastic ring (31) which may be rigid, mid-ring rubber ring (32) which is elastic (rubber) and an inner-ring plastic ring (33) which may be rigid. Inner-ring plastic ring (33) has a central hole. Four guide grooves (34) are arrayed in the central hold. The grooves (34) are configured to receive a respective guide rail (12). Guide rails 12 are provided basic shaft end of the rocking rod. These guide grooves (34) are used for matching the guide rail (12) of rocking rod (1). The placement of mid-ring elastic rubber ring (32) helps the rocking rod (1) return to the original position after the force applied rocking rod (1) is stopped.

A setting ring (8) is placed at the underside part of fixed ring 3 at the guide ring 13 of the base shaft of rocking rod 1. The setting ring (8) has a central hole. Four sections of extruded sheet are positioned in the central hole of setting ring 8 for engaging the end on the shaft of rocking rod (1) when the setting ring is slipped around the rocking rod. This design prevents rocking rod (1) and fixed ring (3) from being segmented and separated as shown in FIG. 2.

Figure 4:
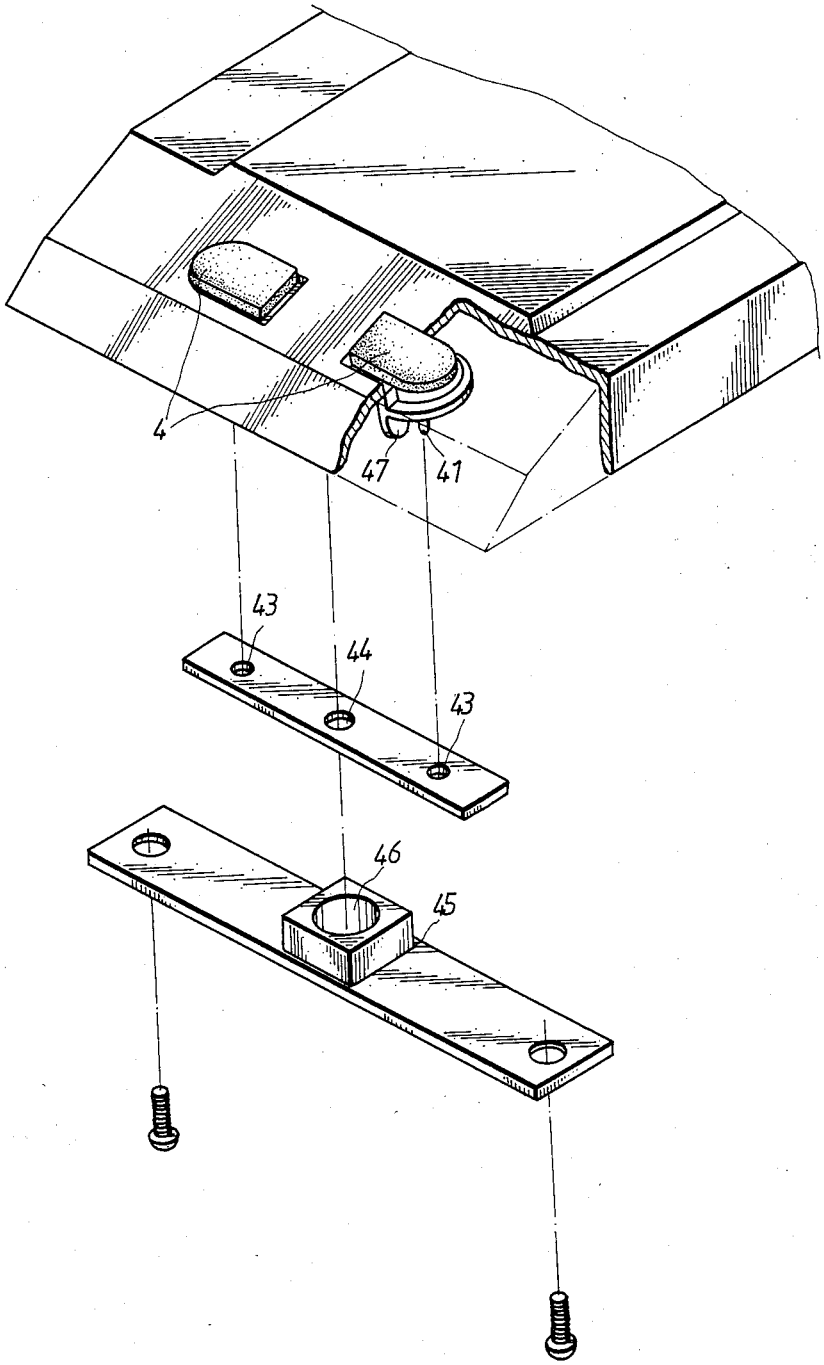
FIG. 4 is a perspective segmented view of an embodiment of key of the present invention.

Another embodiment of the present invention includes a double-key (4) type of operating key at the front end of cover (2) as shown in FIG. 4. In this embodiment, the operating keys can be pressed a singly or simultaneously in a double mode in order to close circuits for transmitting the signals to the video game. A setting column (41) is placed at the bottom side of the double key (4). The setting column matches the setting hole (43) of lever sheet (42). A round downwardly extending protrusion is provided on the lever sheet 42, the central part of lever sheet (42). The bottom of round protrusion (44) of lever sheet (42) will transmit a downward force when a double key is actuated. Then the bottom face of round protrusion (44) contacts top sheet (46) of signal switch (45). Top sheet (46) will sink and produce a signal. When the applied force is stopped, then top sheet (46) will return to the original position by the elasticity of a spring coil which is placed under top sheet (46), as shown in FIG. 4.

The corresponding restrictive hook (47), as shown in FIG. 4, can prevent damage to the key by excessive applied force.

I claim:

1. A rocking rod assembly for new types of horizontal contact video games comprising:

a rocking rod(;) of which the central section has four guide rails;

ring means for receiving said rocking rod, wherein said rocking rod having a base shaft extending through said ring means; and said ring means includes a centrally positioned passageway, said passageway having four guide grooves, each said guide groove configured to receive a corresponding guide rail, and whereby positioning said rocking rod in place without having un-intentional self-rotation;

a setting ring means fitting around a portion said base shaft of said rocking rod for mounting said rocking rod in operative relationship to said ring means;

a circuit means for controlling the switching of an electric signal transmitted to said video game, said circuit means including switching elements; and said circuit means including rod receiving means for receiving said base shaft of said rocking rod, whereby during use movement of said rocking rod moves said base shaft thereby providing the means for selectively independently actuating each of said switching elements; and a key means.

2. A rocking rod assembly according to claim 1, wherein said circuit means further includes:

a base ring encircling and capping the end of a base shaft;

a main body block having a square shaped central portion wherein said base ring is operatively positioned;

four spring elements, each said spring element respectively defining a wall conforming to the square shaped central portion of said main body block, each said spring element mounted on said body block;

a shaft stopping ring associated with each said spring element for transmitting a force applied to a respective said spring element via said base ring;

a flexible guide sheet means associated with each said shaft means for contacting a said shaft means when a said shaft means is urged against a said guide sheet means, each said guide sheet means having an electrical output contact; and an output means associated with a said guide sheet means such that when said base ring pushes against a said spring element a said shaft means contacts a said guide sheet means and a said guide sheet means contacts said output means whereby an electrical circuit is completed between a said output contact of a said guide sheet means and a said corresponding output means.

* * * * *